United States Patent [19]

Iida et al.

[11] Patent Number: 4,883,265

[45] Date of Patent: Nov. 28, 1989

[54] TRAY APPARATUS

[75] Inventors: Noriyoshi Iida, Ichikawa; Nobutaka Uto, Yokohama; Masakazu Hiroi, Tokyo; Akimitsu Hoshi, Yokohama, all of Japan

[73] Assignee: Canon Kabushiki Kaisha, Tokyo, Japan

[21] Appl. No.: 226,551

[22] Filed: Jul. 28, 1988

Related U.S. Application Data

[63] Continuation of Ser. No. 839,603, Mar. 14, 1986, abandoned.

[30] Foreign Application Priority Data

| | | | |
|---|---|---|---|
| Mar. 15, 1985 | [JP] | Japan | 60-052055 |
| Mar. 18, 1985 | [JP] | Japan | 60-055486 |
| Mar. 20, 1985 | [JP] | Japan | 60-057139 |

[51] Int. Cl.[4] ..... B65H 31/26

[52] U.S. Cl. ..... 271/220; 271/201

[58] Field of Search ..... 271/178, 220, 198, 201; 226/186; 355/14 SH

[56] References Cited

U.S. PATENT DOCUMENTS

| | | | |
|---|---|---|---|
| 3,411,686 | 11/1968 | Bender | 226/186 X |
| 3,516,657 | 6/1970 | Knudsen | 271/178 X |
| 3,704,793 | 12/1972 | Nicol | 271/178 X |
| 3,847,388 | 11/1974 | Lynch | 271/220 X |
| 4,285,511 | 8/1981 | Abe | 271/178 |

*Primary Examiner*—Richard A. Schacher

*Attorney, Agent, or Firm*—Fitzpatrick, Cella, Harper & Scinto

[57] ABSTRACT

A tray apparatus for stacking sheets discharged from an image forming apparatus such as a copying machine, a printer, a facsimile machine and other recording machines. The tray apparatus has a sheet aligning member in the form of an endless web which is contactable to the top surface of the sheet which has been discharged onto a tray or bin tray so as to displace the sheet in the opposite direction until the trailing edge of the sheet abuts a stopper member which is disposed adjacent that end of the tray which is near the discharging outlet. By doing so, the sheets discharged are aligned against the stopper member.

11 Claims, 7 Drawing Sheets

TRAY APPARATUS

This application is a continuation of application Ser. No. 839,603, filed Mar. 14, 1986, now abandoned.

FIELD OF THE INVENTION AND RELATED ART

The present invention relates to a tray apparatus for stacking sheet materials discharged from an image forming apparatus such as a copying apparatus, a printer, a facsimile apparatus and other recording apparatus, more particularly, to a tray apparatus which aligns the sheets discharged therefrom and to an image forming apparatus provided with the same.

In order to align the sheet discharged onto a tray, it is conventional to incline the tray upwardly toward outside, that is, away from the sheet receiving side, whereby the sheet discharged thereonto moves back by the gravity with the result that the trailing edge of the sheet abuts a stopper.

However, it is very difficult to select the proper angle of inclination of the tray because the alignment of the trailing edges of the sheets is performed by the gravity applied thereto, wherein the influence of the gravity varies depending on the material of the sheet and the discharging force applied to the sheet when it is kicked out onto the tray.

When, as shown in FIG. 1, z-folded sheet S' is discharged by a couple of discharging rollers 1 and 2 and is received on the tray 3, the non-folded part F is raised by the weight of the three-folded part E thereof, with the result that it is not possible to properly stack and align a number of z-folded sheet S'. This is because the tray 3 is inclined, which results in that the weight of the three-folded part F applies to the non-folded part which is at lower level.

It is considered in order to avoid this problem that the tray is disposed horizontally. However, in that case, it is required that the tray is constructed as a box, and an additional mechanism is employed to align the trailing edge and a lateral edge of the sheet discharged onto the tray in the orthogonal directions. This results in a complicated and bulky mechanism.

As shown in FIG. 2, an apparatus has been proposed in U.S. Pat. No. 3847388, wherein a flapper F is fixed on one of the discharging rollers 2, and the flapper F is of an elastic material and is extended outwardly beyond the outer periphery of the roller 2. The flapper F rotates with the rotation of the shaft so as to discharge the sheet S to the tray 3 and also moves the discharged sheet S by its bottom surface so as to abut the trailing edge of the sheet S to a stopper A which is provided at the trailing edge of the tray.

However, since this apparatus kicks the sheet S out to the tray 3 by the rotation of the flapper F, the sheet S may sometimes be run too far with the result that it is obliquely inclined. Also, since the flapper F acts on the sheet S intermittently, it can occur that the flapper F does not properly act on the sheet S so that the sheet is not correctly aligned along the stopper. Additionally, it is inconvenient that the rotation of the flapper F produces noise.

SUMMARY OF THE INVENTION

Accordingly, it is a principal object of the present invention to provide a tray apparatus which is provided with aligning means for aligning in good order the sheets discharged onto the tray.

It is another object of the present invention to provide a tray apparatus provided with alignment means which is effective to prevent inclination of the sheet.

It is a further object of the present invention to provide a tray apparatus having alignment means not producing noise.

It is a further object of the present invention to provide a tray apparatus having alignment means which is effective to correctly abut the trailing edge of the sheet to a stopper.

It is a further object of the present invention to provide a tray apparatus having alignment means which is capable of align z-folded sheets.

According to an embodiment of the present invention, an endless belt is rotated together with a discharging roller, so that the sheet is discharged to the tray by rotation of the discharging roller, during which the bottom surface of the sheet is contacted to the belt so as to be conveyed in one direction. Then, the top surface of the sheet is contacted by the belt so as to be conveyed in the opposite direction and aligned with stopper means. Thus, the belt acts on the sheet continuously so that no noise is produced, and the sheet is not kicked out, and therefore, the sheet is not inclined (is not moved obliquely).

Also, when the z-folded sheets are to be discharged and aligned, the bulging of the stack of the discharged sheets can be prevented.

Additionally, the trailing edges of the discharged sheets are kept contacting the belt, whereby the oblique movement of the sheet can be prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
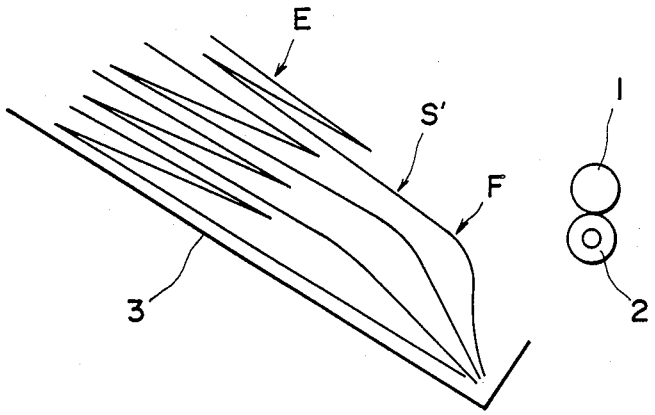
FIG. 1 PRIOR ART
FIG. 1 is a side view of a conventional tray apparatus wherein the tray is illustrated as the one for stacking z-folded sheets.
Figure 2:
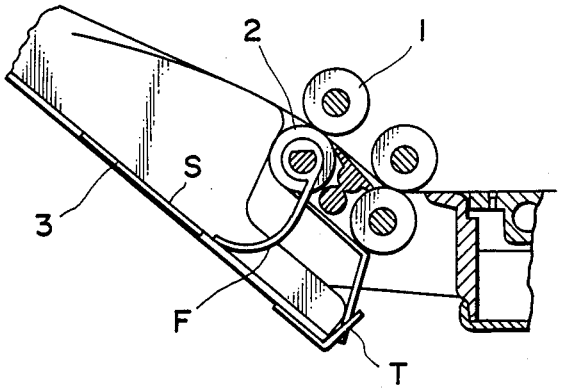
FIG. 2 PRIOR ART
FIG. 2 is a side view of another conventional tray apparatus.
Figure 3:
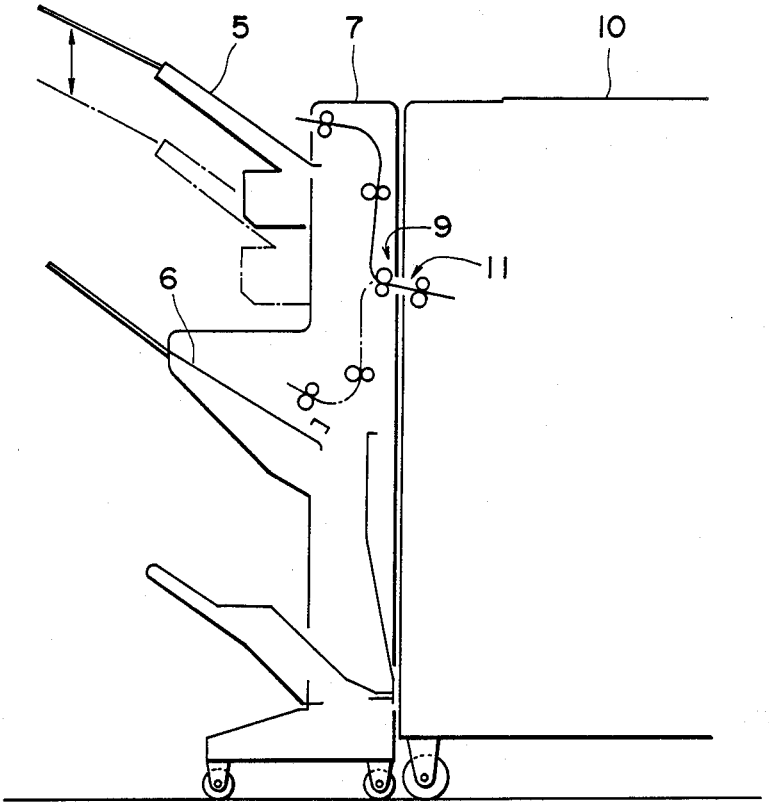
FIG. 3 is a side view of a finisher apparatus coupled with a copying apparatus.

Referring now to FIG. 3, there is shown a finisher apparatus 7 having a stapling portion (station) 6 provided with a tray according to an embodiment of the present invention.

The finisher apparatus 7 has a sheet receiving inlet 9 aligned with a sheet discharging outlet of a copying machine wherein those apparatuses are arranged in series. The copying apparatus 10 includes an image forming means such as an image bearing member in the form of a photosensitive drum, a charger and image exposure means, of which detailed explanation is omitted since they are well known.

Figure 4:
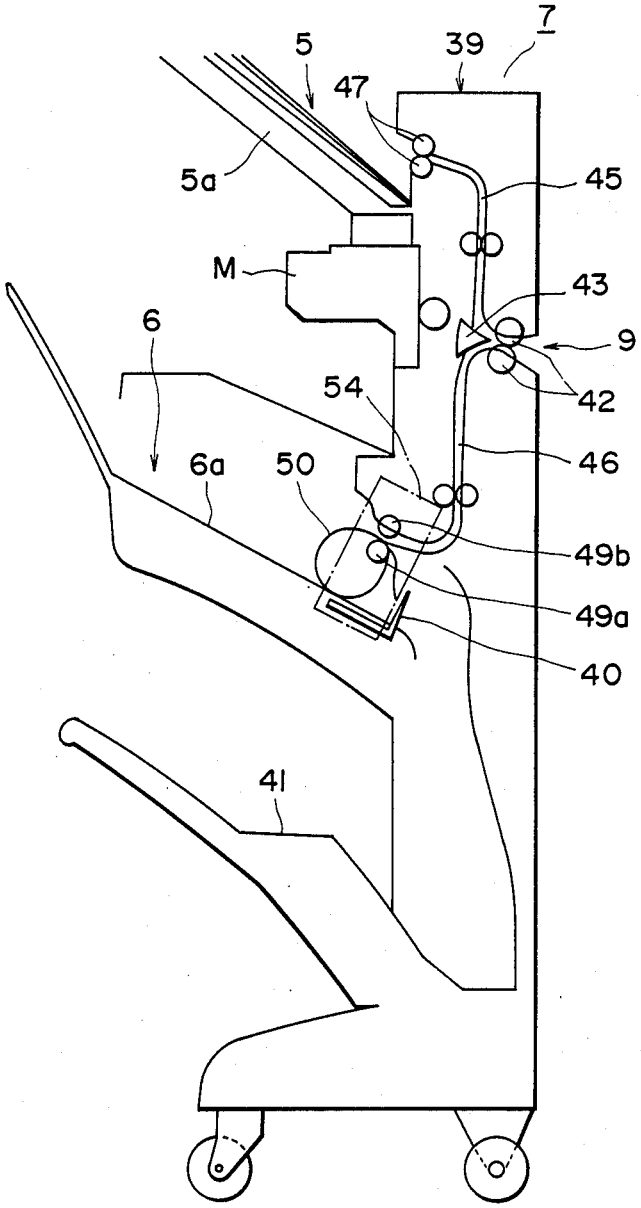
FIG. 4 is a side view of the finisher apparatus.

As shown in FIG. 4, the finisher apparatus 7 is provided with a sheet stacking tray 5*a* which constitutes a stacking portion 5 reciprocable in substantially vertical and horizontal directions. The sheet stacking tray 5*a* is disposed upper rear portion of the main frame 39 of the apparatus. Below the stacker portion 5, intermediate tray 6*a* constituting a stapling portion 6 is mounted to the frame 39 of the apparatus. To that end of the intermediate tray 6*a* which is near the main frame 39, a stopper 540 is rotatably mounted to bear one end of the sheet S on the tray 6*a*. Further, a lower tray 41 is mounted to the main frame 39 below the stapling portion 6. By rotation of the stopper 40, the sheet S or sheets S on the intermediate tray 6*a* fall on the lower tray 41 and are accommodated there. And, the upper front portion of the frame 39 of the finisher apparatus is provided with a sheet receiving inlet 9. The inlet 9 is located at substantially the same level as the sheet discharging outlet 11 of the copying apparatus 10. At the sheet receiving inlet 9, there is provided a receiving roller couple 42. Downstream of the receiving roller couple 42 with respect to movement of the sheet, an inlet deflector 43 is disposed which is effective to switch the direction of sheet transportation in two ways, that is, to selectively direct the sheet S from the sheet inlet 9 to a passage leading to the stacker portion or to a passage 46 leading to the stapling portion. At the downstream end of the stacker passage 45, a discharging roller couple 47 is provided so as to discharge the sheet S to the sheet stacking tray 5*a*.

Figure 5:
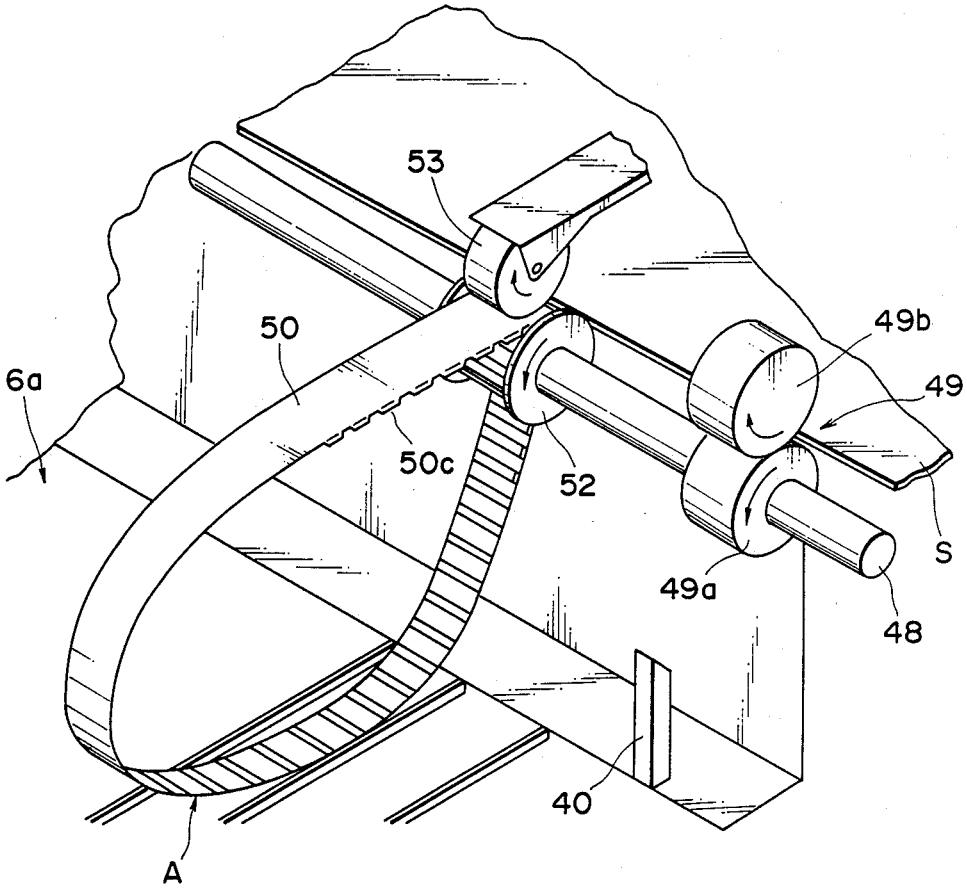
FIG. 5 is a perspective view of a tray apparatus according to an embodiment of the present invention.

As shown in FIG. 5, at the downstream end of the stapling portion passage 46, there is a discharging couple of rollers 49 and 49. A pulley 52 is fixed to a roller shaft 48 to which the lower one 49*a* of the discharging roller couple 49. Around the pulley 52, a sheet aligning web in the form of an endless belt 50 in this embodiment is trained, and the lower part A of the belt 50 is contacted to the top surface of the intermediate tray 6*a*. Inside of the belt is formed into inner gears 50*c* extending in the direction perpendicular to movement of the belt 50. The gear 50*c* of the belt 50 is meshed with an outer gear formed on the pulley 52. The belt 50 is interposed between the upper roller 53 and the pulley 52 so that the belt 50 rotates together with the lower one 49*a* of the discharging roller couple. As shown in FIG. 4, above the bottom end of the intermediate tray 6*a*, there is disposed a stapler 54 which is effective to staple the sheets on the intermediate tray 6*a*.

In operation, the sheet S discharged from the outlet 11 of the copying apparatus 10, is conveyed by the rotation of the receiving roller couple 42 at the sheet inlet 9 to the inner deflector 43. When the stacking mode wherein the sheets S are stacked on the sheet stacking tray 5*a*, the inlet deflector 43 selects the passage to the stacker portion passage 45, whereby the sheet S is conveyed through the stacker portion passage 45, and discharged onto the sheet stacking tray 5*a* by the rotation of the discharging roller couple 47. If desired, the sheet stacking tray 5*a* may be shifted in a horizontal direction so as to classify the discharged sheet S. Also, the sheet stacking tray 5*a* may be lowered by a driver means M in accordance with the height of the stack of the sheets S on the tray 5*a* so as to keep a constant height through which the sheet falls from the discharging roller couple 47 to the topmost sheet S of the stack of the sheets on the sheet stacking tray 5*a*.

Figure 6:
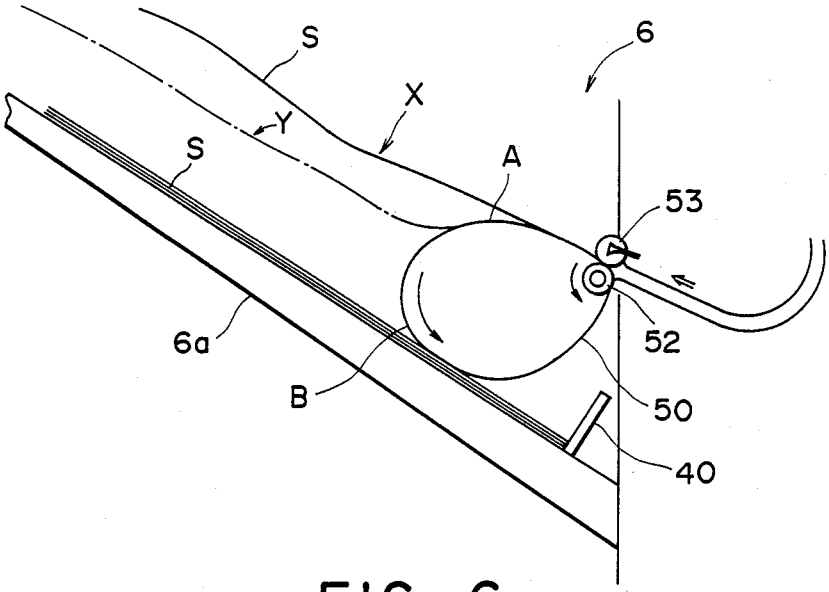
FIG. 6 is a side view of the tray apparatus of FIG. 5.

When the stapling mode is selected wherein the sheets S are stacked and then stapled, the inlet deflector 43 selects the passage leading to the stapling portion passage 46, so that the sheet S is conveyed through the passage 46. Then, as shown in FIG. 5, the sheet S is discharged onto the intermediate tray 6*a* by the rotation of the discharging roller couple 49 and the sheet aligning belt 50. During this, the bottom surface of the sheet S is contacted by the upper running portion A of the belt 50 which is moving and is conveyed in the manner indicated by X and Y in FIG. 6. Subsequently, the sheet S is completely discharged on the intermediate tray 6*a* adjacent to the belt 50. At this time, the trailing edge of the sheet S is kept contacted to the belt 50, whereby the lateral deviation of the sheet is prevented. Then, the top surface of the sheet S thus discharged is now contacted by the lower running part B of the belt 50, so that the sheet S is interposed and gripped between the belt 50 and the top surface of the tray 6*a*. Therefore, the sheet S is conveyed back by the movement of the belt 50, that is, in the direction opposite to the direction in which the sheet S is discharged. The backward movement is effected until the trailing edge of the sheet abuts the stopper 40 and is aligned thereto. After the sheet is aligned, the belt 50 slips on the sheet. After a desired number of the sheets S are stacked on the intermediate tray 6*a* in an aligned manner, the end portions thereof are stapled by a stapler 51. Then, the stopper 40 rotates to allow the stapled sheets S to fall on the bottom tray 41 and are accommodated there.

Figure 7:
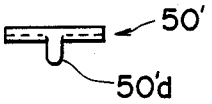
FIG. 7 is a sectional view of a part of a tray apparatus according to another embodiment of the present invention.

In this embodiment, the sheet aligning belt 50 has a number of inner gear teeth 50*c*. However, this is not limiting. As an alternative example, as shown in FIG. 7, a belt 50′ may be used in place thereof, the belt 50′ having a rib 50′*d* formed on the inner surface of the belt 50 extending along the center thereof in the direction of movement of the belt 50′. The pulley 52 in this case is provided with a groove corresponding to the rib 50′*d*. This belt 50′ is effective to prevent it from running off and is effective to keep the resiliency in pressing the lower part thereof to the tray. Further, in this embodiment, one belt 50 is used, but this is not limiting, and two or more of such belts 50 may be used so that more stabilized sheet alignment operation is assured.

Figure 8:
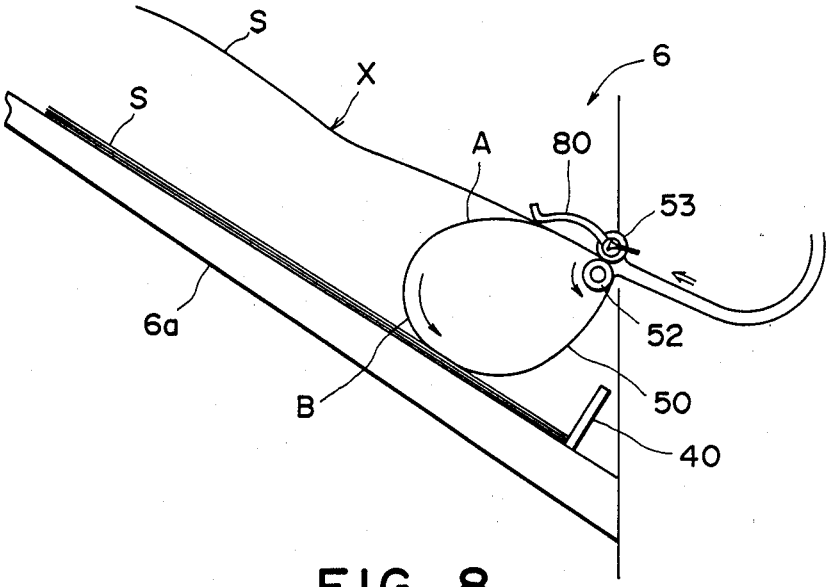
FIG. 8 is a sectional view of a part of a tray apparatus according to a further embodiment of the present invention.

As shown in FIG. 8, as an alternative example, a lightly confining member 80 may be used in order to maintain a proper contact between the belt 50 and the sheet S. In this example, the confining member 80 has a light weight by which it can lightly confine the sheet.

As described in the foregoing, according to an embodiment of the present invention, a rotatable member 52 is fixed on a rotational shaft such as a shaft 48 of the discharging roller, and a sheet alignment web in the form of an endless belt 50 is trained around the rotational member 52 in the manner that the lower part B of the belt is contactable to the tray 6a, and the belt 50 is interposed and gripped between the rotational member 52 and a roller 53. Therefore, the sheet S can be always aligned against the stopper 40, irrespective of the discharging force of the discharging roller couple 49 and the material of the sheet S. The sheet S discharged from the discharging roller couple 49 is conveyed by the sheet alignment belt 50 and is discharged to the tray 6a adjacent to the belt 50, whereby the sheet S is not obliquely or inclinedly kicked out. Also, since the sheet alignment belt 50 continuously acts on the sheet S, the sheet S can be always properly aligned by the belt 50. Additionally, no noise is produced because of the alignment of the sheets S.

Figure 9:
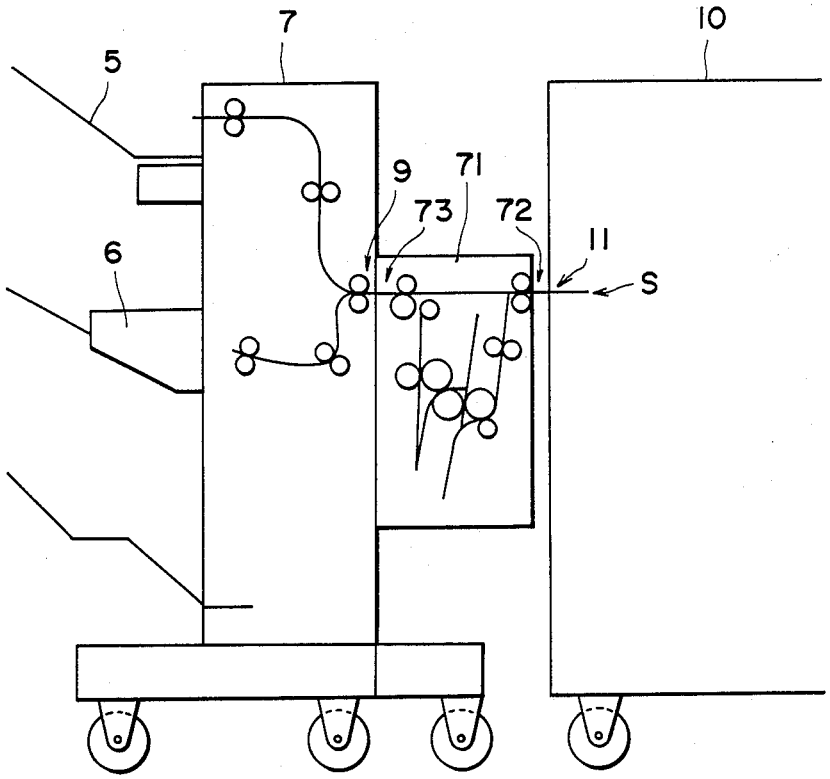
FIG. 9 is a side view of a copying machine which is equipped with a folding machine and a finisher apparatus.

FIG. 9 illustrates another embodiment of the present invention, wherein the tray apparatus according to this embodiment is used in the stapling portion 6 of a finisher apparatus 7.

The finisher apparatus 7 has a sheet receiving inlet 9 which is aligned with the sheet discharging outlet 73 of a sheet folding apparatus 71. The sheet receiving inlet 72 of the folding apparatus 71 when the folding apparatus 71 is set to the finisher apparatus 7, is aligned with the sheet discharging outlet of the copying machine. The finisher apparatus 7, the folding apparatus 71 and the copying apparatus 10 are arranged in series in this manner. The detailed explanation of the finisher apparatus 7 is omitted because it is substantially the same as the one disclosed in FIG. 4.

In operation, when z-folded sheets S' are received and are aligned on the stapling portion 6 of the finisher apparatus 7, the sheet S discharged from the sheet discharging outlet 11 of the copying apparatus 10 is first processed by the sheet folding apparatus 71 to be formed into a z-folded sheet S'. The folded sheet S' is conveyed by the rotation of the receiving roller couple 42 from the sheet receiving inlet 9 to the inlet deflector 43. When a stacking mode is selected wherein the sheet S is stacked on the sheet stacking tray 5a, the inlet deflector 43 selects the stacking portion passage 45 so that the z-folded sheet S' is conveyed through the stacking portion passage 45 and is discharged by the discharging roller couple 47 to the sheet stacking tray 5a.

When the stapling mode is selected wherein the sheets are stacked and stapled, the inlet deflector 43 selects the stapling portion passage 46, so that the z-folded sheet S' is conveyed through the stapling portion passage 46.

Figure 10:
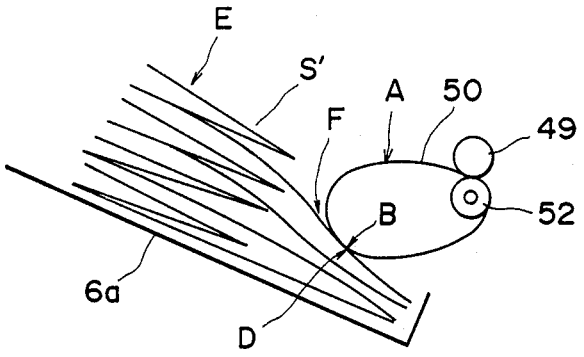
FIG. 10 is a side view of a tray apparatus according to an embodiment of the present invention, which stacks z-folded sheets.

As shown in FIG. 10, the z-folded sheet S' is discharged to the intermediate tray 6a by the rotation of the discharging roller couple 49 and the rotation of the belt 50 which is effective to align the sheet S' and also to prevent bulging of the stack of the z-folded sheets S'. During this, the bottom surface of the sheet S' is contacted to the upper running portion A of the belt 50 until it is discharged to the intermediate tray 6a adjacent to the belt 50. Then, the top surface of the z-folded sheet S' now discharged is contacted to the lower portion B of the belt 50 and is interposed between the tray 6a and the belt 50. Thus, the sheet S' is moved back by the belt 50 until the trailing edge of the sheet S' abuts the stopper 40 and aligned thereagainst.

As shown in FIG. 10, the lower portion B of the belt 50 is contacted to the non-folded portion D of the z-folded sheet while the belt being rotating, so that the rise of the non-folded part F of the z-folded sheet which may otherwise be caused by the weight of the three-folded part of the sheet S' or by the rebounding force of the folds, can be prevented. As a result, a number of z-folded sheets S' can be properly stacked and aligned.

When a desired number of z-folded sheet S' are stacked and aligned on the intermediate tray 6a by the repetition of the above-operations, the end portions of the sheets S' are stapled by a stapler 51. Then, the stopper 40 rotates to allow the z-folded and stapled sheets S' to fall on the bottom tray 41 and are accommodated there.

In the foregoing description of this embodiment, only the z-folded sheets S' are received and aligned on the intermediate tray 6a. However, this is not limiting, but two-folded sheets alone may be received or they are mixed with the three-folded sheets. It will be understood that the belt 50 effects the above described functions in those cases with proper alignment and without bulging or rise.

Figure 11:
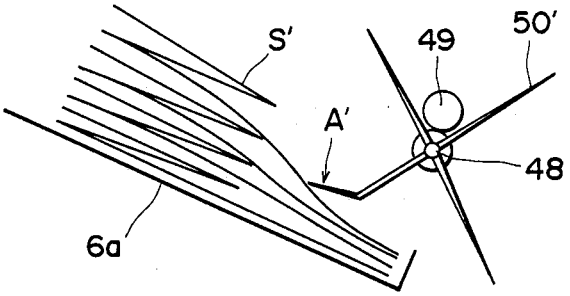
FIG. 11 is a side view of a tray apparatus according to another embodiment of the present invention.

In the foregoing description, the bulging preventing belt 50 is provided on the discharging roller shaft 48. However, as shown in FIG. 11, an elastic or resilient paddle members 50' may be fixed on the discharging roller shaft 48 so that the bulging of the stack of the sheets on the intermediate tray 6a is prevented by the rotation and contact of the lower portion A' of the paddle members to the sheets S' by rotation of the discharging roller shaft 48.

As described in the foregoing, according to this embodiment of the present invention, an elastic or resilient member effective to align the sheets and also to prevent bulging of the stack of the sheets is fixed on the roller shaft 48 to which the discharging roller 49a is fixed, whereby the resilient member 50 is rotated by the roller shaft 48, and the lower portion B of the belt 50 is contacted to the tray 6a. Therefore, even when z-folded sheets S' are stacked on the tray 6a, the non-folded part D of the sheet S' can be confined by the rotation and contact of the belt 50 to the topmost sheet S', and therefore, the bulging of the stack at the non-folded portion F can be prevented. Such bulging may otherwise be caused by the weight of the three-folded part E of the sheets. Accordingly, a number of sheets S' can be properly stacked and aligned on the tray.

While the invention has been described with reference to the structures disclosed herein, it is not confined to the details set forth and this application is intended to cover such modifications or changes as many come within the purposes of the improvements or the scope of the following claims.

What is claimed is:

1. A tray apparatus, comprising:

a sheet discharging outlet provided with a rotatable member for discharging sheets;

a tray for receiving and stacking sheets discharged from said sheet discharging outlet, said tray being provided with a stopper at a side adjacent said sheet discharging outlet; and a rotatable endless belt disposed adjacent said sheet discharging outlet and having a part disposed opposite to a top surface of said tray, said endless belt having a first travel portion for contacting the bottom surface of a sheet being discharged through said sheet discharging outlet, for conveying the sheet in a direction of sheet discharge, and for contacting the rear end of the sheet to convey it downwardly to said tray, said endless belt also having a second travel portion for contacting a top surface of the sheet which is being discharged to convey the sheet back in the opposite direction so as to abut it to the sheet stopper.

2. An apparatus according to claim 1, wherein said endless belt is contactable to top surfaces of said sheets by its own weight.

3. An apparatus according to claim 2, wherein said endless belt rotates with said rotatable member.

4. An apparatus according to claim 2; wherein said endless belt is of an elastic material.

5. An apparatus according to claim 4, wherein said endless belt is partly trained around a pulley coaxial with said rotatable member and is partly suspended to contact the top surfaces of said sheets.

6. An apparatus according to claim 5, further comprising an urging roller for urging said endless belt toward the pulley.

7. An apparatus according to claim 1, further comprising a stapler adjacent the stopper.

8. An image forming apparatus comprising:

means for forming an image on sheets;

a tray, including a sheet discharging outlet provided with a rotatable member for discharging the sheets, for receiving and stacking sheets discharged from said sheet discharging outlet, said tray being provided with a stopper at a side adjacent to said discharging outlet; and a rotatable endless belt disposed adjacent said sheet discharging outlet and having a first travel portion for contacting the bottom surface of the sheet which is being discharged through said sheet discharging outlet to convey the sheet in a direction of sheet discharged onto said tray, and having a second travel portion for contacting a top surface of the sheet which is discharged to convey the sheet back in the opposite direction so as to abut the sheet stopper.

9. A tray apparatus, comprising:

a sheet discharge outlet provided with a plurality of rotatable members for discharging sheets;

a tray for receiving and stacking sheets discharged from said sheet discharge outlet, said tray being provided with a stopper at a side adjacent to said sheet discharging outlet, and said tray being inclined downwardly toward said side;

a rotatable endless belt disposed adjacent said sheet discharge outlet and having a contact part suspended to be contactable to a top surface of said tray, said endless belt being supported coaxially with a lower one of said rotatable members, the contact part being adapted to contact top surfaces of the sheets discharged from said sheet discharge outlet, said endless belt being rotatable in a direction to move the sheets to said stopper in a direction opposite to a direction of sheet discharge from said sheet discharge outlet.

10. A tray apparatus, comprising:

a sheet discharge outlet provided with a plurality of rotatable members for discharging sheets;

a tray for receiving and stacking sheets discharged from said sheet discharge outlet, said tray being provided with a stopper at a side adjacent to said sheet discharging outlet, and said tray being inclined downwardly toward said side;

a rotatable endless belt disposed adjacent said sheet discharge outlet and having a contact part suspended to be contactable to a top surface of said tray, said endless belt being supported coaxially with a lower one of said rotatable members, said endless belt including a first travel portion adapted to contact bottom surfaces of sheets being discharged from said sheet discharging outlet to impart a drive thereto in a direction of sheet discharge onto said tray, and a second travel portion adapted to contact top surfaces of the sheets discharged from said sheet discharge outlet to impart a drive thereto in a direction opposite to the sheet discharging direction to abut the stopper.

11. An apparatus according to claim 10, wherein said first travel portion is effective to push trailing edges of the sheets to move them downwardly to said tray.

* * * * *

UNITED STATES PATENT AND TRADEMARK OFFICE

CERTIFICATE OF CORRECTION

PATENT NO. : 4,883,265

DATED : November 28, 1989

INVENTOR(S) : NORIYOSHI IIDA, ET AL.

It is certified that error appears in the above-identified patent and that said Letters Patent is hereby corrected as shown below:

COLUMN 1, line 20, "the" (first occurrence) should be deleted;
line 24, "the" should be deleted;
line 25, "the" (second occurrence) should be deleted.

COLUMN 2, line 15, "align" should read --aligning--;
line 30, "the" (first occurrence) should be deleted;
line 33, "contacting" should read --in contact with--.

COLUMN 3, line 20, "disposed" should read --disposed at the--;
line 50, "49" should read --49 is mounted--;
line 54, "Inside" should read --The inside--;
line 67, "When" should read --When in--.

COLUMN 4, line 49, "50" should read --50'--.

COLUMN 5, line 62, "and" should read --and is--;
line 65, "belt being" should read --belt is--.

COLUMN 6, line 20, "an" should be deleted.

UNITED STATES PATENT AND TRADEMARK OFFICE

CERTIFICATE OF CORRECTION

PATENT NO. : 4,883,265 Sheet 2 of 2

DATED : November 28, 1989

INVENTOR(S) : NORIYOSHI IIDA, ET AL.

It is certified that error appears in the above-identified patent and that said Letters Patent is hereby corrected as shown below:

COLUMN 8, line 2, "discharging" should read --discharge--;

line 21, "discharging" should read --discharge--.

Signed and Sealed this

Twenty-fifth Day of December, 1990

*Attest:*

HARRY F. MANBECK, JR.

*Attesting Officer*

*Commissioner of Patents and Trademarks*